US007364537B2

(12) United States Patent
Wang et al.

(10) Patent No.: US 7,364,537 B2
(45) Date of Patent: Apr. 29, 2008

(54) WIND RESISTANCE MECHANISM FOR AN EXERCISE APPARATUS

(76) Inventors: Leao Wang, No. 1, Lane 233, Sec. 2, Charng Long Rd., Taiping (TW) 411; Peter Wu, No. 1, Lane 233, Sec. 2, Charng Long Rd., Taiping (TW) 411

( * ) Notice: Subject to any disclaimer, the term of this patent is extended or adjusted under 35 U.S.C. 154(b) by 738 days.

(21) Appl. No.: 10/862,174

(22) Filed: Jun. 7, 2004

(65) Prior Publication Data

US 2005/0272579 A1 Dec. 8, 2005

(51) Int. Cl.
*A63B 22/12* (2006.01)

(52) U.S. Cl. ..... 482/111; 482/58; 482/63

(58) Field of Classification Search ..... 482/62, 482/63, 72, 73; 416/133, 161, 163–168 R, 416/186 A; 267/168, 169, 174, 177; 188/290, 188/296; *A63B 22/12*
See application file for complete search history.

(56) References Cited

U.S. PATENT DOCUMENTS 6,019,479 A * 2/2000 Barker ..... 362/96
6,488,611 B1 * 12/2002 Ambrosina et al. ..... 482/63
7,037,074 B2 * 5/2006 Hoshino ..... 416/62

* cited by examiner

*Primary Examiner*—Terrence R. Till
*Assistant Examiner*—Ryan Durcik

(57) ABSTRACT

A wind resistance mechanism for an exercise apparatus is provided which includes a plurality of bendable blades for changing the form of the wind-facing side thereof or adjusting the wind-facing angle. A movable clamping device includes a hub supported on an output shaft of an exercise apparatus. A first and a second disc are mounted on the hub. At least one of both discs performs a reciprocating movement in axial direction. An external force is applied to the discs for changing the form of the wind-facing side of the blades or adjusting the wind-facing angle, thereby adjusting the wind resistance.

8 Claims, 4 Drawing Sheets

WIND RESISTANCE MECHANISM FOR AN EXERCISE APPARATUS

BACKGROUND OF THE INVENTION

1. Fields of the Invention

The invention relates to a wind resistance mechanism for an exercise apparatus, and more particularly, to an apparatus that can change the form of the wind-facing side of blades or adjusting the wind-facing angle, thereby adjusting the wind resistance.

2. Description of the Related Art

Exercise apparatuses are designed to improve physical strength. One type thereof makes use of resistance against the force exerted. The training items includes strength of grasp, lifting strength, hand strength, foot-stamping force, running force, chest-expanding exercise for improving cardiopulmonary function, etc. The resistance sources are spring, weight, wind, hydraulic, magnetic resistance, etc.

Exercise apparatuses with wind resistance mechanism are various. TW 78207560, TW79200894, etc. disclose different types of wind resistance apparatus. A plurality of blades pivotally connected to a frame are employed for providing resistance. When the blades are rotated, each of the blades creates resistance by facing wind, and the created resistance can be used for training.

Since the form of the wind resistance blades and the angle of airflow passing through the blades are fixed, the created wind resistance basically remains unchanged apart from the change of speed of the blades. In fact, everyone has his own physical state so that the conventional wind resistance mechanism can't meet different needs of operators.

SUMMARY OF THE INVENTION

It is a primary object of the invention to provide a wind resistance mechanism for an exercise apparatus that changes the wind-facing form of blades for adjusting the wind resistance.

Another object of the invention is to provide a wind resistance mechanism for an exercise apparatus that changes the wind-facing angle of blades for adjusting the wind resistance.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
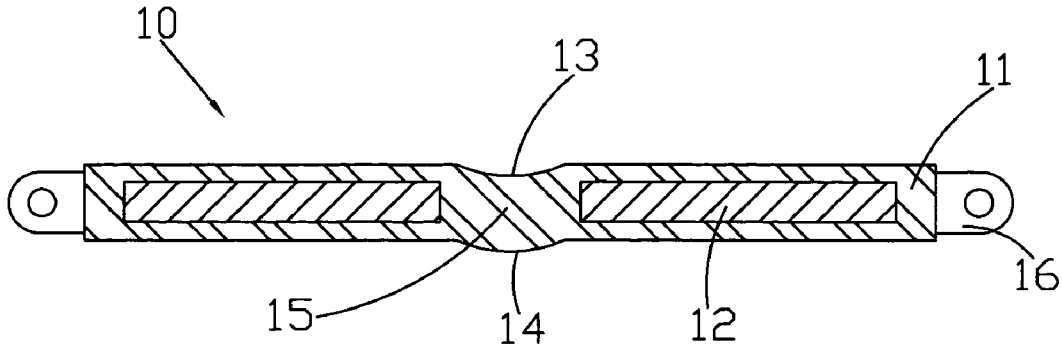
FIG. 1 is a cutaway view of a blade of the invention.

Referring to FIG. 1, a blade 10 in accordance with the invention includes an enclosing layer 11 made of bendable or flexible material and two stiffening members 12 spaced apart. Two pivoting portions 16 are formed at both ends of the blade 10. A concave portion 13 between both stiffening members 12 is formed atop the middle part of the blade 10 while a ridge 14 is formed at the bottom thereof. The portion between the concave portion 13 and the ridge 14 is a flexible area 15. The angle of both sides of the blade 10 with respect to a horizontal plane is adjustable by bending the blade 10.

Figure 4:
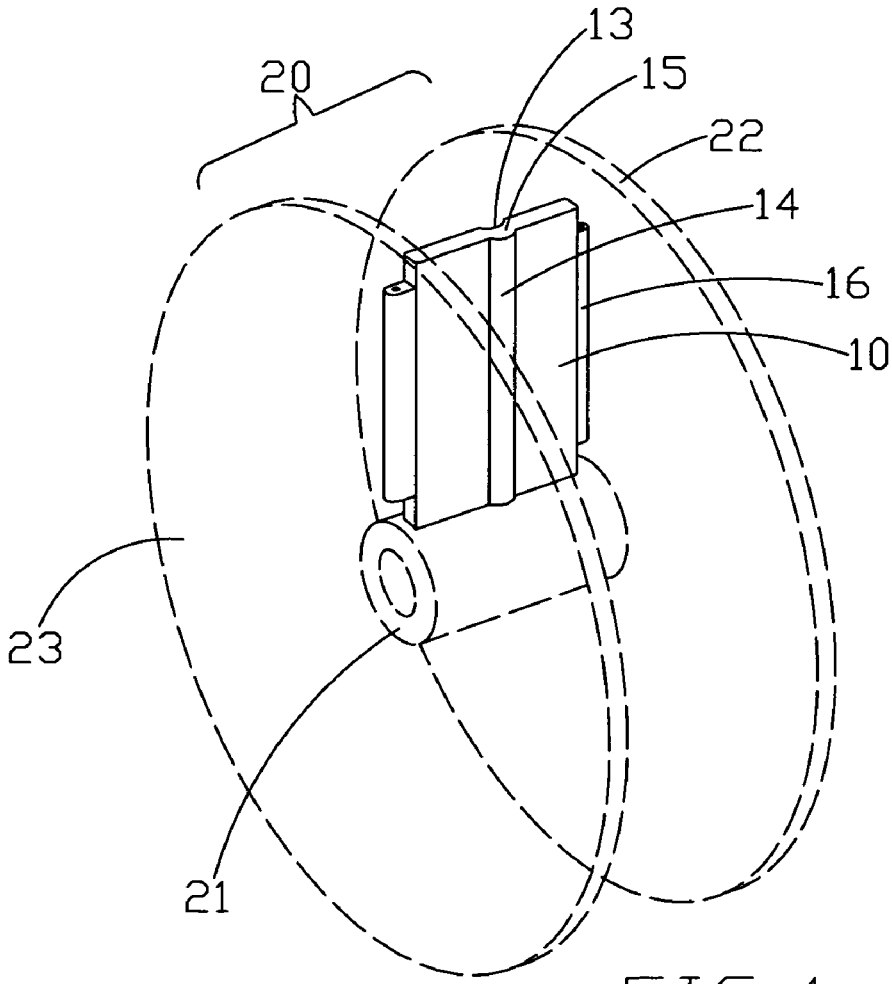
FIG. 4 is a perspective view of the blade according to FIG. 1 that is interposed between both discs.

As shown in FIG. 4, the blade 10 can be installed in a clamping device 20. Each of the discs 20 includes a hub 21 mounted on an output shaft of an exercise apparatus. The blade 10 is interposed between two discs 22, 23 on the hub 21. At least one of the discs 22, 23 is inwardly and outwardly movable in axial direction for imparting a reciprocating motion to the blade 10.

Figure 2:
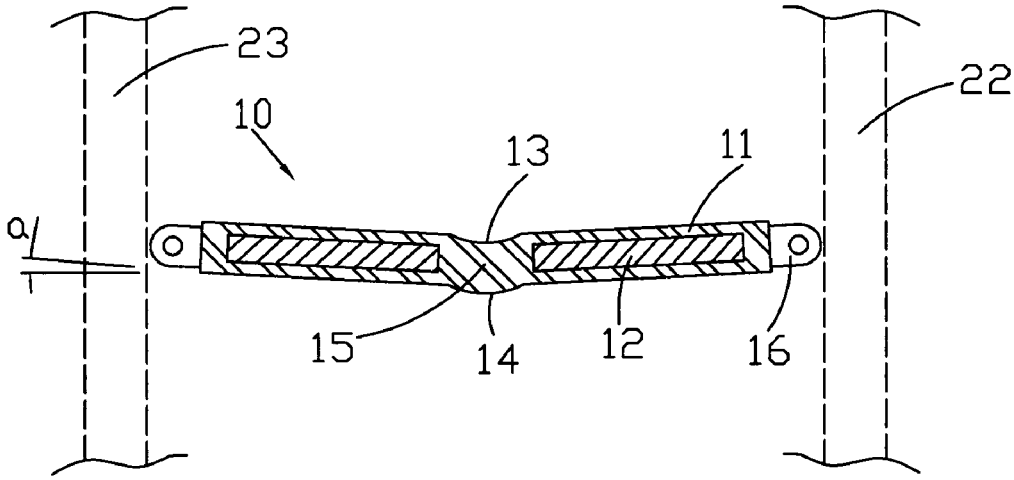
FIG. 2 is a cutaway view of the blade according to FIG. 1 that is pivotally connected to discs.

As shown in FIG. 2, the blade 10 pivotally connected to the discs 22, 23 meets a horizontal plane at an angle a of 0° through 20°. When an object moves in the air, the pressure field around it is not evenly distributed. The concrete distribution is dependent on the form, size, fluid Viscosity coefficient and speed of the object. Normally, the front side belongs to high pressure area while the rear side or drainage side is low pressure area. When the output shaft imparts motion to the hub 21, the air will be compressed to force the current to flow to all sides around the clamping device 20. At that time, the blade 10 is easily bent to form an angle (160° through 180°) between both sides of the blade 10. The body facing to the wind is almost a planar body, thereby resulting in a greater resistance to the airflow. Meanwhile, the wind resistance is relatively strong.

Figure 3:
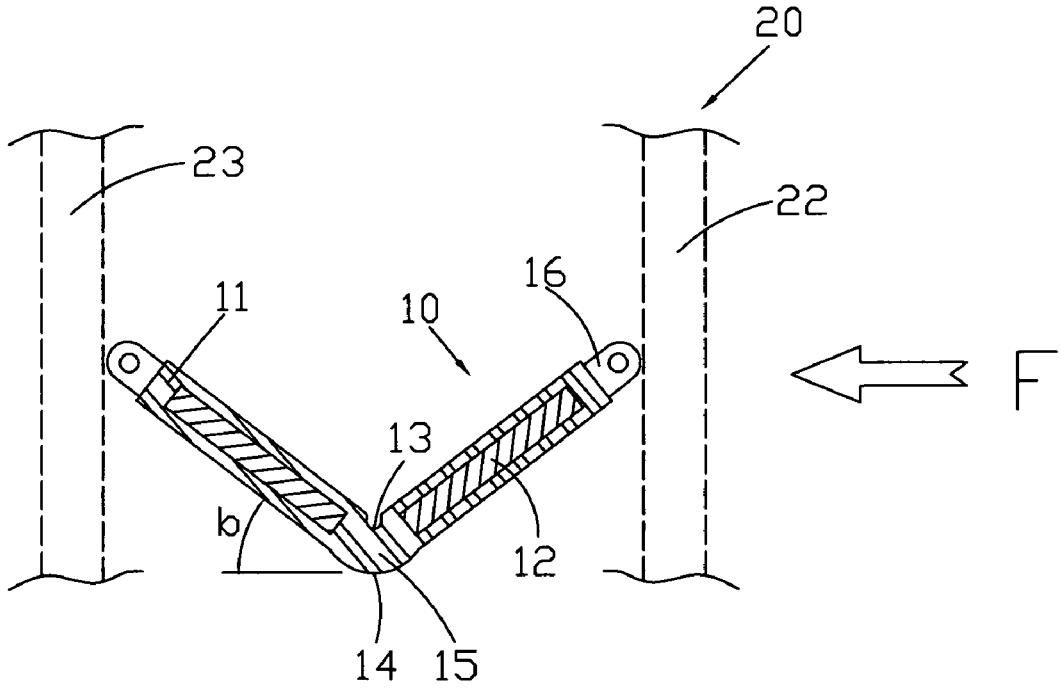
FIG. 3 is a cutaway view of the blade according to FIG. 2 in a bent position.

In order to adjust the wind resistance, an external force F, as shown in FIG. 3, can be applied to one or both discs 22, 23 so that the discs 22, 23 move inwardly in axial direction and the blade 10 is indirectly bent. It's apparent from FIG. 3 that the included angle b between the bottom side of the blade 10 and a horizontal plane is inversely proportional to the distance between both discs 22, 23. Accordingly, the body facing to the wind is almost a conic form. In this way, the high pressure in the high pressure area in front of the blade 10 according to FIG. 3 is smaller than that according to FIG. 2. Thus, the effect in adjusting the wind resistance is evident.

Figure 5:
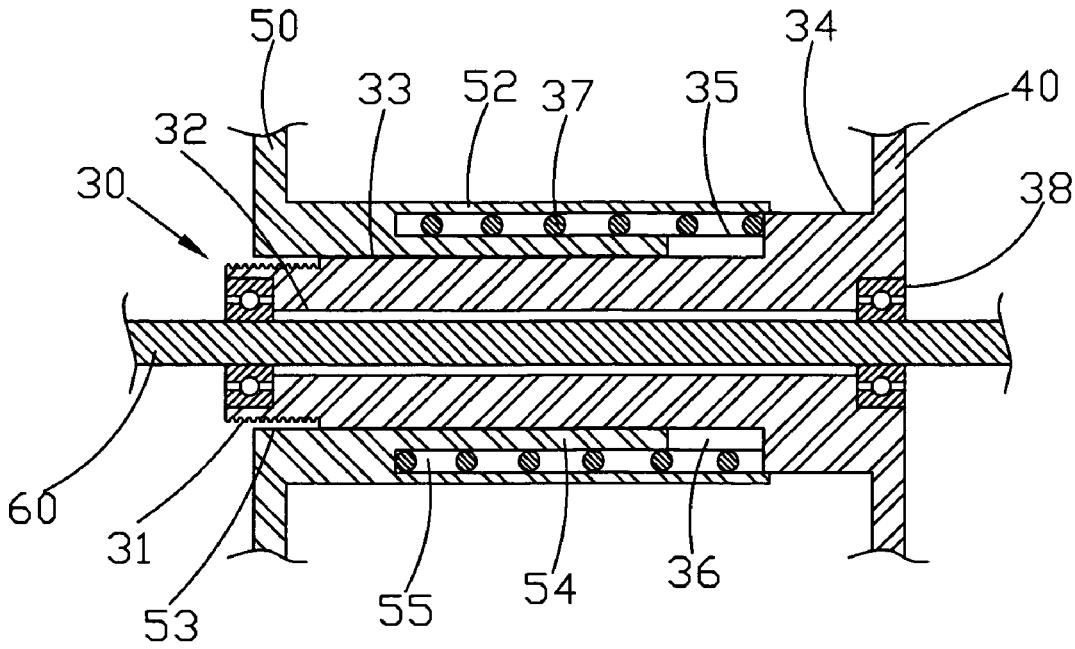
FIG. 5 is a cutaway view of another embodiment of the invention.
Figure 6:
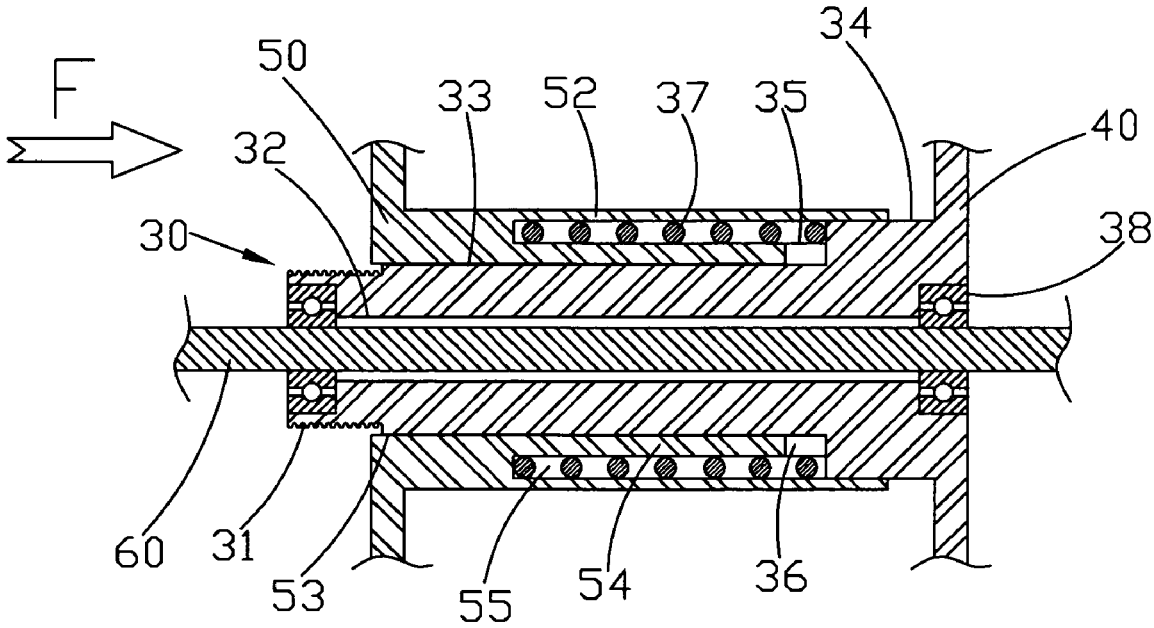
FIG. 6 is a cutaway view of the embodiment according to FIG. 5 with an external force applied to one of two discs.
Figure 7:
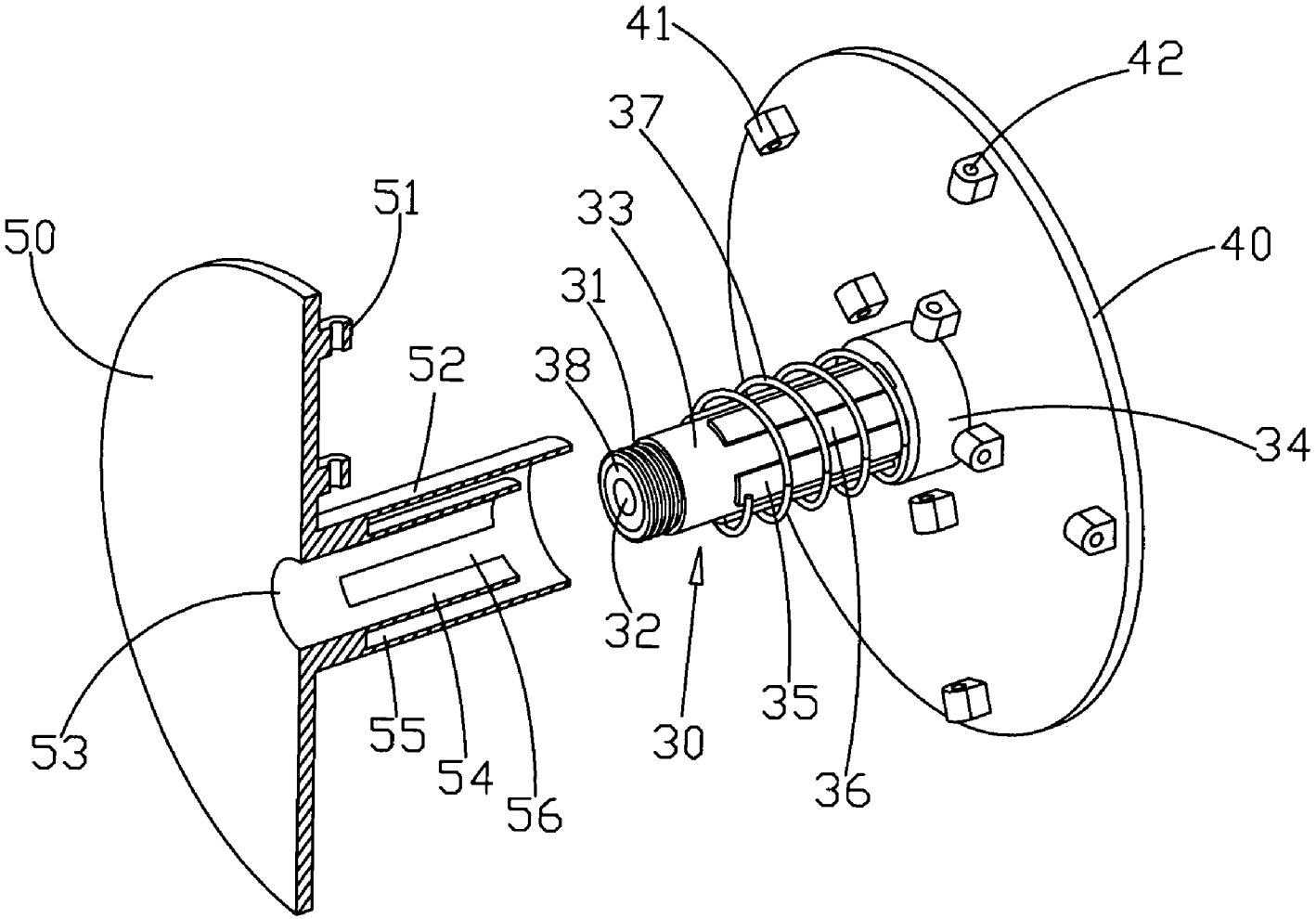
FIG. 7 is a perspective view of the embodiment according to FIG. 5.

A second disc 50 of a clamping device according to FIGS. 5 through 7 includes a plurality of uniformly spaced positioning pieces 51 the inner side thereof each of which has a through hole 42. Every two positioning pieces 51 are spaced apart to a great extent along a phantom radial line. Moreover, a socket 52 is perpendicularly extended from the center of the internal side of the second disc 50. An axial hole of the socket 52 meets a mounting hole 53 of the second disc 50. An annular groove 55 is formed in the socket 52, thereby creating an external and an internal wall of the socket 52. The internal wall of the socket 52 includes a plurality of spaced grooves 56, and a guide stripe 54 is formed between every two spaced grooves 56.

A tubular hub 30 with a force-applying portion 31 includes a shaft hole 32 with a bearing 38. A shaft-receiving tube 33 is extended between an annular piece 34 and the force-applying portion 31. A plurality of uniformly spaced strips 35 are formed on the shaft-receiving tube 33. A guide channel 36 axially extended to the annular piece 34 is formed between every two neighbored strips 35. The annular piece 34 is formed on the internal side of a first disc 40. The internal side of the first disc 40 includes a plurality of positioning pieces 41 with through holes 42 that correspond to the positioning pieces 51 on the second disc 50.

In assembly, a spring element 37 is received in the annular groove 55 or mounted on the tubular hub 30. Thereafter, the guide stripes 54 and the strips 35 are aligned with the guide channels 36 and the spaced grooves 56, respectively. The first disc 40 and the second disc 50 are inwardly compressed to force the tubular hub 30 into the mounting hole 53. At that time, the spring element 37 lies between the annular groove 55 and the annular piece 34. Then, the aforementioned blades 10 can be pivotally connected to the positioning pieces 41, 51 of the first and the second disc 40, 50.

Under the ordinary circumstance, both discs 40, 50, as shown in FIG. 5, are spaced far apart due to the resilient force of the spring element 37. At that time, the blades 10 pivotally interposed between both discs 40, 50 are almost planar. When the tubular hub 30 is mounted by the bearings 38 on the output shaft 60, it will be rotated by the output shaft 60, thereby creating a greater resistance to airflow and, therefore, forming a larger wind resistance force.

In adjusting the wind resistance, an external force, as shown in FIG. 6, is applied to the second disc 50. Then, the second disc 50 is inwardly moved in axial direction to bend the blades 10. In this way, the wind-facing angle of the blades 10 gradually decreases and the wind-facing form thereof tends to be comic.

The above-mentioned embodiment of the invention can adjust the wind-facing angle or change the wind-facing form, thereby achieving the effect of adjusting wind resistance. In addition, the invention can have the following alternative embodiments:

1. The socket 52 in accordance with FIG. 7 ensures a protection of the strips 35, guide channels 36, guide stripes 54 and the spring element 37 from contamination. Therefore, the whole operational function of the invention won't be affected by eliminating the socket 52. Moreover, a portion similar to the annular piece 34 is formed at the closed end of the annular groove 55 of the second disc 50. Thus, a unidirectional movable wind resistance mechanism is created.
2. Based on the embodiment of FIG. 7, the socket 52 and the guide stripe 54 of the second disc 50 can be removed so that the annular groove 55 disappears to form a portion similar to the annular piece 34. Moreover, the spaced grooves 56 are formed within the mounting hole 53 while the strips 35 is lengthened to the interface of the force-applying portion 31 and the shaft-receiving tube 33. Thus, the annular piece 34 is mounted on the tubular hub 30 for an axial displacement. Accordingly, another unidirectional movable wind resistance mechanism is created.
3. Based on the embodiment of FIG. 7, both discs 40, 50 can be independently provided and include the annular piece 34 and positioning pieces 41, 51. The annular piece 34 has the mounting hole 53. A plurality of spaced grooves 56 are also provided. The tubular hub 30 includes force-applying portions 31 at both ends thereof. The shaft-receiving tube 33 has longer strips 35. In this way, both discs 40, 50 are mounted on both ends of the tubular hub 30 and apply a pressure against the spring element 37. After the blade 10 are pivotally connected, a two-way movable wind resistance mechanism is created.

With respect to the external force, it can be provided by the following mechanisms:

1. Manual type: a screwing element can be employed to impart axial motion through the force-applying portion 31 to the disc.
2. Mechanic type: a clamping element can be employed to impart axial motion through the force-applying portion 31 to the disc. Alternatively, a motor can be employed to impart axial motion through the force-applying portion 31 to the disc. In addition, a hydraulic driving mechanism can be employed to impart axial motion through the force-applying portion 31 to the disc.
3. Automatic type: an electronic control element is employed to impart axial motion through the force-applying portion 31 to the disc.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A wind resistance mechanism for an exercise apparatus comprising:

a) a movable clamping device having a hub and two discs, the hub being supported on an output shaft, the discs being movable in axial direction, and b) a plurality of blades interposed between both discs;

whereby an external force is applied to one of the discs to control the form of the wind-facing side of the blade, thereby adjusting the wind resistance;

c) two force-applying portions formed at both ends of the hub, a shaft-receiving tube being interposed between both force-applying portions, a plurality of strips being formed on the shaft-receiving tube, a guide channel axially extended to the annular piece being formed between every two neighbored strips;

d) an annular piece formed on one of the opposing faces of both discs, the annular piece having a mounting through hole, a plurality of the spaced grooves being formed in correspondence to the strips for ensuring a reciprocating movement in axial direction on the tubular hub; and e) a spring element received in the annular groove and mounted on the tubular hub.

2. A wind resistance mechanism for an exercise apparatus comprising:

a) a tubular hub adapted to ensure an axial displacement, the tubular hub being supported on an output shaft of the exercise apparatus, b) a first disc rigidly attached to a first end of the tubular hub, c) a second disc movably supported on a second end of the tubular hub for ensuring a reciprocating movement in axial direction, and d) a plurality of blades interposed between both discs, the angle of the wind-facing side of the blades being passively adjustable by the reciprocating movement of the second disc.

3. The wind resistance mechanism of claim 2 further comprising:

a) a force-applying portion formed at one or both ends of the hub, a shaft-receiving tube being extended to the other end of the hub, the first disc being positioned on the annular piece, a plurality of strips being formed on the shaft-receiving tube, an guide channel axially extended to the annular piece being formed between every two neighbored strips, and b) a mounting through hole formed in the second disc, the second disc having an annular piece on one side thereof, the annular piece having a plurality of guide stripes on an internal wall thereof, a spaced groove being interposed between every two neighbored guide stripe for ensuring a reciprocating movement in axial direction on the tubular hub, and c) a spring element received in the annular groove and mounted on the tubular hub.

4. The wind resistance mechanism of claim 3 wherein the second disc includes a socket formed on an external wall of the annular piece, and wherein the annular groove is formed between the socket and the guide strips for receiving the spring element and protecting related components from contamination.

5. The wind resistance mechanism of claim 1 or 2 wherein the blade includes an enclosing layer made of bendable or flexible material and two stiffening members spaced apart and received in the enclosing layer, and wherein the portion between both stiffening members is a flexible area, and wherein the form of the wind-facing side of the blade varies with the reciprocating movement of the discs in axial direction, thereby ensuring an indirect adjustment of the wind-facing angle and the wind resistance.

6. The wind resistance mechanism of claim 5 wherein the enclosing layer includes a concave portion adjacent to the flexible area.

7. The wind resistance mechanism of claim 5 wherein the enclosing layer includes a ridge adjacent to the flexible area.

8. A wind resistance mechanism for an exercise apparatus comprising:

a) a tubular hub adapted to ensure an axial displacement, the tubular hub being supported on an output shaft of the exercise apparatus, b) a first disc rigidly attached to a first end of the tubular hub, c) a second disc movably supported on a second end of the tubular hub for ensuring an reciprocating movement in axial direction, and d) a plurality of blades interposed between both discs, the blades passively adjusting the angle of the wind-facing side by the reciprocating movement of the second disc.

* * * * *